United States Patent [19]

Hasegawa et al.

[11] Patent Number: 4,903,905

[45] Date of Patent: Feb. 27, 1990

[54] METHOD OF BALANCING A YARN WINDER

[75] Inventors: Katsumi Hasegawa; Michio Ohno, both of Kusatsu; Akira Kadotsuji, Otsu, all of Japan

[73] Assignee: Toray Industries, Inc., Japan

[21] Appl. No.: 333,099

[22] Filed: Apr. 3, 1989

Related U.S. Application Data

[60] Division of Ser. No. 290,844, Dec. 29, 1988, Pat. No. 4,852,810, which is a continuation of Ser. No. 15,218, Feb. 17, 1987, abandoned.

[30] Foreign Application Priority Data

Feb. 20, 1986 [JP] Japan ..... 61-35821
Feb. 20, 1986 [JP] Japan ..... 61-35824

[51] Int. Cl.[4] ..... B65H 54/02
[52] U.S. Cl. ..... 242/18 R
[58] Field of Search ..... 242/18 R, 18 DD, 35, 242/46.2, 46.21, 46.3, 46.4, 46.5, 46.6, 68, 68.1, 68.2, 68.3; 74/573 R; 73/468, 469, 470; 29/901

[56] References Cited

U.S. PATENT DOCUMENTS

| | | | |
|---|---|---|---|
| 3,593,932 | 7/1971 | Altice et al. | 242/18 DD |
| 3,813,051 | 5/1974 | Miller | 242/46.4 |
| 3,917,182 | 11/1975 | Lenk | 242/18 R |
| 3,970,260 | 7/1976 | Bruggisser et al. | 242/18 DD |
| 4,087,055 | 5/1978 | Yasuda et al. | 242/18 DD |
| 4,326,677 | 4/1982 | Schippers et al. | 242/18 R X |
| 4,394,985 | 7/1983 | Graf et al. | 242/18 DD |
| 4,458,850 | 7/1984 | Sugioka et al. | 242/46.4 |
| 4,575,015 | 3/1986 | Sugioka et al. | 242/46.4 |

*Primary Examiner*—Stanley N. Gilreath
*Attorney, Agent, or Firm*—Austin R. Miller

[57] ABSTRACT

A method of balancing a spindle in a yarn winder comprising, (a) a base for supporting a yarn take-up means, (b) the yarn take-up means including, (b-1) a spindle driving mechanism mounted to the base, (b-2) a long spindle comprising, (b-2-1) a bobbin holding portion more than 800 mm in length including a first cylindrical hollow body, a cylindrical and substantially solid body connected to the first cylindrical hollow body and a second cylindrical hollow body connected to the cylindrical solid body, and (b-2-2) a shaft extending from a center of the inner end of the cylindrical solid body along the axis thereof through the interior of the second cylindrical hollow body and projecting therefrom, the shaft being connected to the spindle driving mechanism, (b-3) bearing means for rotatably supporting the spindle on the base, and (b-4) a bobbin holding mechanism secured around the periphery of the bobbin holding portion, for detachably mounting thereon at least a bobbin for taking up a yarn, the steps which comprise balancing the bobbin holding portion dynamically by field-balancing carried out by adjusting a test weight in each of at least three planes defined at opposition ends of the bobbin holding portion and an intermediate point therebetween, each of the weights being determined from sensing vibration data obtained by vibration testing carried out with and without an added test weight in each of said at least three planes extending at an angle to the axis of said spindle.

20 Claims, 14 Drawing Sheets

METHOD OF BALANCING A YARN WINDER

The present invention is a divisional of U.S. Ser. No. 290,844, filed December 29, 1988, now U.S. Pat. No. 4,852,810, which is a continuation of U.S. Ser. No. 015,218, filed February 17, 1987, now abandoned.

BACKGROUND OF THE INVENTION

1. Field of the Invention

It relates to a method of balancing a yarn winder, more particularly, to a method of balancing a yarn winder which enables a stable take-up of synthetic filament yarn spun from a spinning apparatus at a high speed while avoiding serious spindle vibration.

2. Description of the Related Art

Recently, an increase in the speed of a synthetic fiber manufacturing process has been made to improve the productivity of the process and the quality of a yarn thus produced. Particularly, in a novel process, a full oriented yarn [FOY] having good mechanical properties durable in practical use is obtained directly from a spinning apparatus by continuously connecting the spinning and drawing processes, in which the yarn is taken up at a rate in a range of from 5,000 m/min to 6,000 m/min. This means that a high speed take-up winder is now in practical use.

Along with the increased speed of the winder, a winder provided with a longer spindle compared to a standard spindle having a total length of, for example, 600 mm for carrying four bobbins having a length of 150 mm, or 1,200 mm for carrying eight bobbins, is desirable in order to improve the productivity and to decrease the cost of production of the yarn. Moreover, there is also a strong need to minimize the number of operators necessary for the threading operation and decrease the amount of waste accompanying this operation.

Under these circumstances, it has become very important to develop a method of balancing a yarn winder provided with a long spindle rotatable at a high speed while carrying a multiple of bobbins thereon, particularly with an automatic yarn transfer device.

In considering the vibrations encountered in a spindle the term "critical speed of a spindle" is a generic term encompassing all of the first, second and third critical speeds all of which produce violent lateral vibrations of the spindle as its speed of rotation increases above zero. Specific critical speeds are defined as follows:

The first critical speed, sometimes called the primary critical speed, is the critical speed of the spindle which first occurs as the speed of rotation is increased from zero. The second critical speed is the critical speed of rotation of the spindle which occurs secondly as the speed of rotation is increased above the first critical speed. It arises mainly from the vibration of the tubular supporting member.

The third critical speed of the spindle is another of the critical speeds of the spindle and is the third to occur as the speed of rotation is further increased above the second critical speed. It arises mainly from the vibration of the rearward cylindrical hollow body of the bobbin holding portion of the spindle.

One of the most serious problems arising when a winder with the long spindle is put into practice, is vibration of the spindle when rotating at a high speed. There are two ways to minimize the vibration; one is to increase the stiffness of the spindle and use the same in a rotational range beneath the first critical speed of the spindle which is one of the critical speeds of the spindle at each of which a violent lateral vibration of the spindle occurs, and which appears firstly during increasing of rotational speed of the spindle from zero, hereinafter referred to as the first critical speed. This, however, is almost impossible in practice, because it is very difficult to increase the stiffness of the spindle due to the longer size thereof. Accordingly, the other way is more frequently adopted, which is disclosed in, such as U.S. Pat. No. 3,917,182 granted to E. Lenk, Nov. 4, 1975, or Japanese Examined Patent Publication (Kokoku) No. 57-34187 of Mitsubishi Heavy Industries Co., Ltd., July 21, 1982, and utilizes a spindle having a flexible structure able to withstand a rotation above the first critical speed.

For example, to obtain a good yarn package by taking up a yarn on a bobbin having a length of 150 mm and a diameter of 110 mm mounted on a spindle, at a linear speed of 6,000 m/min, there must not be any critical speeds of the spindle, hereinafter referred to as the critical speed, in a wide working range of the spindle rotation of from 17,360 rpm at the starting stage to 4,550 rpm at the final stage of a full package.

Therefore, various factors affecting the stiffness of the spindle, such as a diameter of a shaft of the spindle, or a position of a bearing means rotatably supporting the shaft, should be determined to exclude the critical speed from the working range of the rotation of the spindle.

In practice, it is very difficult to take up a yarn in a stable condition only by excluding the critical speed from the working range, and generally, it is very difficult to machine a long spindle with a sufficient accuracy to eliminate bending of the shaft and eccentricity between the inner and outer diameters of the spindle, which results in a considerable unbalance in the spindle.

Accordingly, even though the respective parts, such as a shaft of a spindle or an element of a bobbin holding mechanism, are accurately balance-corrected with a balancing device in a low speed range, a complete elimination of unbalance is impossible and a satisfactory balance cannot be achieved.

Moreover, during assembly of the spindle and incorporation of the same into a winder, a new unbalance may be added due to discordance between the axes of a spindle and a mechanism for holding a bobbin on the spindle and the eccentricity of bearing means for mounting the spindle.

When the spindle is driven to rotate in such circumstances, a centrifugal force is generated in the first critical speed area due to the above unbalance, which causes a large vibration and noise at the winder. In such a case, the bearing means is subjected to an excessive force, which lowers the life of the bearing means, and in an extreme case, damages the spindle shaft. Also, this vibration degrades the quality of a yarn package formed on the spindle, and deteriorates the labour environment.

Accordingly, it is necessary to remove the residual unbalance from the completed spindle assembly by the balance-correcting operation, referred to as "field balancing".

The present inventors tried to correct a dynamic unbalance of a spindle for holding bobbins thereon, having a considerable residual unbalance therein due to its longer size, by field-balancing only in two correcting planes defined at the opposite extremities of the spindle. It was, however, impossible to remove the mass unbalance continuously distributed on the spindle along the length thereof only by correcting the dynamic unbalance in the planes of the opposite ends, and the vibration of the spindle was not decreased not only when passing the critical speed but also while normally winding a yarn at a working speed of the spindle. This is because the unbalance non-uniformly distributed in the spindle has a complicated influence on the first critical speed, and the respective vibration levels in the area of the working rotation cannot be corrected by a simple field-balancing in only the two end planes.

Further, it was found that if the vibration of the spindle is restricted to a lower level when the spindle speed passes the first critical speed, the vibration in a range of the working rotation of the spindle becomes larger, and vice versa, and thus the vibrations occurring when passing the first critical speed and in the working rotation area could not be simultaneously suppressed. In general, since the vibration in the working rotation area is limited to a lower level, the other vibration when the spindle passes the first critical speed must reach the higher level.

The spindle necessarily passes the first critical speed twice during the cycle of starting, acceleration, deceleration, and stop of the winder, whereby a bearing means for rotatably supporting the spindle suffers from an excessive force originated from the vibration and the lift thereof is lowered, which vibration is transmitted to a machine frame and may loosen screw connections in the machine, causing an unsafe condition therein.

The abovesaid drawbacks are particularly significant in a winder with an automatic yarn transfer device. In the winder of this kind, a yarn package is formed on a bobbin or bobbins mounted on a first spindle and pressed thereon at a predetermined pressure by means of a touch roll through the transverse reciprocation of a yarn by a traversing device, which package must be doffed from the first spindle when the same is full. Before the first spindle is stopped, a second spindle mounting fresh bobbins thereon is accelerated from a stationary state to a working speed, during which acceleration the second spindle must pass the first critical speed and the vibration thereof becomes very large. This vibration is transmitted to the first spindle, the touch roll, and a lifting box supporting the traversing device through the machine frame, and finally causes the lifting box to vibrate. Because of this disturbance, the yarn package being formed on the first spindle becomes unstable, causing deformation of the appearance and damage to the as-wound yarn by the periodic change of the pressure between the touch roll and the yarn package. In an extreme case, the yarn package jumps from the touch roll, whereby the yarn is released from the traversing device and a failure of the take-up operation occurs.

Further problems occur in the manufacture of a long spindle. In general, a bobbin carrying portion of such a long spindle is a single hollow cylinder, and a tubular member for holding the bearing means of a spindle shaft is projected from a machine frame and inserted into the interior of the hollow cylinder, as disclosed in the aforesaid U.S. Pat. No. 3,917,182 and Japanese Examined Patent Publication (Kokoku) No. 60-5508. To obtain such a spindle structure, a long hollow portion must be drilled in the spindle. In the case of a standard spindle, having a length of, for example, 600 mm, for mounting four bobbins thereon, the above boring may be carried out correctly. In the case of a longer spindle having a length exceeding, for example, 1,000 mm, length, however, it is very difficult to support the spindle without eccentricity during the boring of the long hollow portion. In addition, the drill bit must be supported at a tip end of a long and narrow shank having less rigidity, whereby the drill bit may be bent and deviated from the correct axis during the operation and provide an eccentric boring. Accordingly, a significant difference in a wall thickness may exist along the length of the spindle, which inevitably causes the vibration, and in an extreme condition, the spindle speed cannot exceed the first critical speed.

In addition, the eccentricity of bobbins relative to the spindle mounting the same also causes the above dynamic unbalance.

SUMMARY OF THE INVENTION

It is an object of the present invention to provide a method of producing a yarn winder having a longer spindle having a flexible structure suitably utilized in a range above the first critical speed.

It is another object of the present invention to provide a method of balancing a yarn winder of the above type having a stable take-up function while minimizing the vibration in the working speed range as well as in the vicinity of the first critical speed.

It is a further object of the present invention to provide a method of balancing a yarn winder of the above type with an automatic yarn transfer device, in which a yarn to be taken up is not damaged even when the yarn transfer is carried out between two spindles rotating at substantially the same rotational speed.

According to the present invention, the above object is achieved by a method of balancing a yarn winder comprising method steps applied to (a) a base mounted on a machine frame for supporting a yarn take-up means, and (b) the yarn take-up means including (b-1) a spindle driving mechanism mounted on the base, (b-2) a spindle comprising (b-2-1) a bobbin holding portion including a first cylindrical hollow body, a cylindrical and substantially solid body connected to the first cylindrical hollow body, and a second cylindrical hollow body connected to the cylindrical solid body, and (b-2-2) a shaft extending from a center of the inner end of the cylindrical solid body along the axis thereof through the interior of the second cylindrical hollow body and projecting therefrom, the shaft being connected to the spindle driving mechanism, (b-3) bearing means for rotatably supporting the spindle on the base, and (b-4) a bobbin holding mechanism secured around the periphery of the bobbin holding portion, for detachably mounting thereon at least a bobbin for taking up a yarn, in which the bobbin holding portion is dynamically balanced by field-balancing thereof in at least three planes defined at the opposite ends thereof and an intermediate point therebetween.

The present invention also provides a balancing method wherein the yarn winder comprises (a) a base mounted on a machine frame for supporting a yarn take-up means, and (b) the yarn take-up means including (b-1) a spindle driving mechanism mounted on the supporting member, (b-2) a spindle comprising (b-2-1) a bobbin holding portion including a first cylindrical hollow body, a cylindrical and substantially solid body connected to the first cylindrical hollow body and a second cylindrical hollow body connected to the cylindrical solid body, and (b-2-2) a shaft extending from a center of the inner end of the cylindrical solid body along the axis thereof through the interior of the second cylindrical hollow body and projecting therefrom, the shaft being connected to the spindle driving mechanism, (b-3) a bearing means for rotatably supporting the spindle on the base, and (b-4) a bobbin holding mechanism secured around the periphery of the bobbin holding portion, for detachably mounting thereon at least a bobbin for taking up a yarn, in which the second cylindrical hollow body is formed separately from the cylindrical solid body and is integrated into the latter to form a single part.

BRIEF DESCRIPTION OF THE DRAWINGS

The other objects and advantages of the present invention will be more apparent from the following description with reference to the drawings illustrating the preferred embodiments of the present invention: wherein.

DESCRIPTION OF THE PREFERRED EMBODIMENTS

First Aspect

A first aspect of the present invention aims to provide a method of balancing a yarn winder having a long spindle or spindles, the dynamic unbalance of which is corrected by field-balancing according to the present invention. In the present invention, the "long spindle" stands for the spindle having a bobbin holding portion of more than 800 mm in length.

Figure 1:
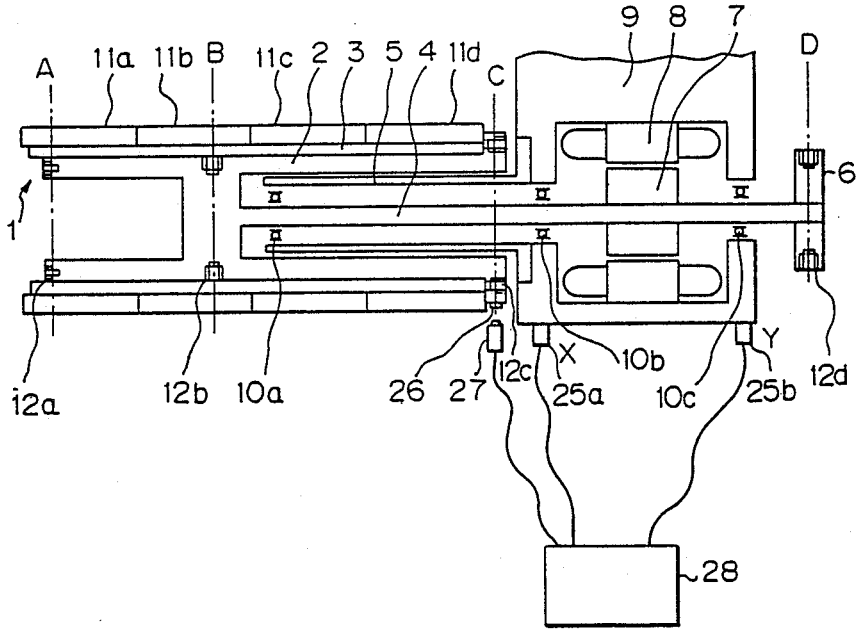
FIG. 1 is a diagrammatic sectional view of a spindle which may be balanced by a method according to a first aspect of the present invention.
Figure 2:
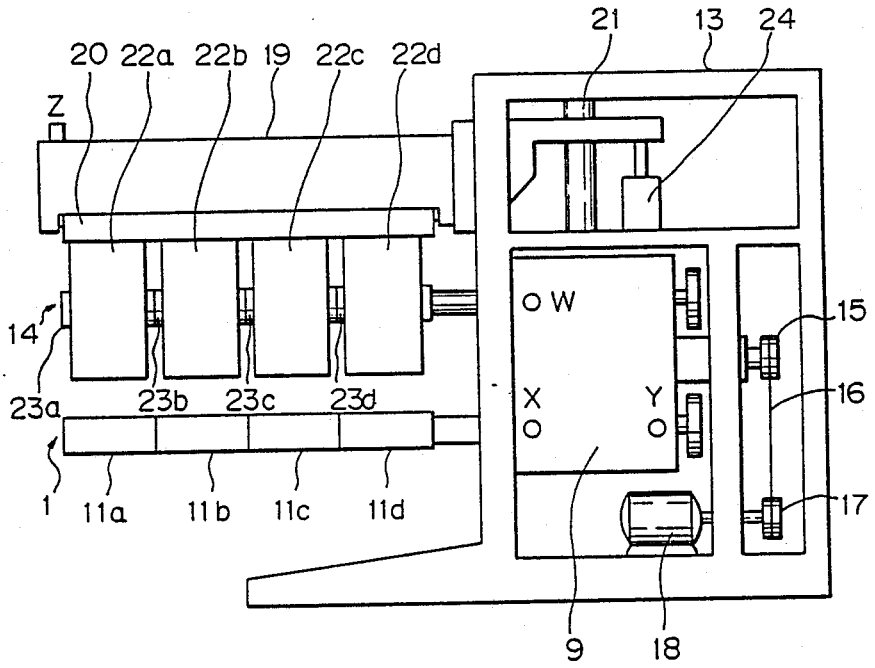
FIG. 2 is a diagrammatic sectional view of a yarn winder provided with the spindle shown in FIG. 1.

With reference to FIGS. 1 and 2, a spindle 1 arranged horizontally comprises a bobbin holding portion 2 provided with a bobbin holding mechanism 3 of a known type for supporting bobbins 11*a*, 11*b*, 11*c*, and 11*d*, and a spindle shaft 4.

The shaft 4 is rotatably supported by a pair of bearings 10*b* and 10*c* arranged in a revolving drum 9 (see FIG. 2) and another bearing 10*a* disposed at a tip end of a tubular supporting member fixed to the revolving drum 9 by screws (not shown). A rotor 7 of a motor is fixed to a portion of the shaft 4 between the bearings 10*b* and 10*c*, and a stator 8 is mounted in the revolving drum 9 so that a torque is imparted to the spindle 1 with the cooperation of the rotor 7 and the stator 8. A brake disc 6 is fixed to a rear end of the shaft 4 to effectively stop the rotation of the spindle 1.

Eight tapped holes 12*a*, each having a female thread in the inner wall, are equiangularly arranged in a first balance-correcting plane. A defined at the tip end of the bobbin holding portion 2, for mounting test weights of known mass in a screw shape when a field balancing operation is carried out. Also in the intermediate region of the bobbin holding portion 2, a second balance-correcting plane B is defined for field balancing. Eight tapped holes 12*b* of a second group are arranged in the same phase as the first holes 12*a* on the periphery of the bobbin holding portion 2 corresponding to the plane B. Further, third and fourth planes C, D are defined at the rear end of the bobbin holding portion 2 and in the disc 6, respectively, in which tapped holes 12*c* and 12*d* are respectively arranged in the same manner as the first holes 12*a*. That is, there are four groups of the tapped holes 12*a*, 12*b*, 12*c*, and 12*d* having the same phase arrangement in the respective balance-correcting planes A, B, C, and D.

It should be noted that the number of the above holes in one group is not limited to eight but may be less or more. Moreover, the holes may not be tapped and/or the arrangement of the holes may not be equiangular, although this is the preferable way for easily and securely mounting the test weight.

FIG. 2 illustrates a diagrammatical view of a winder provided with the above spindle 1. A revolving drum 9 which constitutes a base is supported on a machine frame 13 by bearings (not shown). Spindles 1 and 14 of the same type as that shown in FIG. 1 are mounted on the drum 9, and a sprocket 15 is fixed to the rear end of the drum 9, which is associated, through a chain 16, with another sprocket 17 fixed to an output of a motor 18 and driven thereby.

Yarn packages 22*a*, 22*b*, 22*c*, and 22*d* are formed on the spindle 14 with the aid of a traversing device of a known type (not shown) accommodated in a lifting box 19. The yarn packages 22*a*, 22*b*, 22*c*, and 22*d* are suitably pressed onto the spindle periphery by a touch roll 20 supported in the lifting box 19 at the both ends thereof, and rotation of the spindle 1 is controlled by a controller (not shown) so that a yarn take-up speed is constant.

The lifting box 19 is slidably displaceable in the up-down direction along a vertical pillar 21 by means of a power cylinder 24 connected to the rear portion of the lifting box 19. According to this structure, the lifting box 19 can be lifted in accordance with the development of the yarn packages while keeping the pressure between the yarn packages 22a, 22b, 22c, 22d and the touch roll 20 at an optimum value.

When the yarn having a predetermined length has been taken up on the respective bobbins 23a, 23b, 23c, and 23d mounted on the spindle 14, and the respective yarn packages 22a, 22b, 22c and 22d of the predetermined diameter have been formed, the other spindle 1 carrying empty bobbins 11a, 11b, 11c, and 11d is accelerated to the yarn take-up speed and a series of steps for yarn transfer are then carried out, i.e., the motor 18 is made to start, by which the revolving drum 19 is rotated by half a turn through the chain 16 to transfer the yarn from the full bobbins 23a through 23d to the fresh bobbins 11a through 11d. On the other hand, the spindle 14 carrying the full packages 22a, 22b, 22c and 22d is brought to a rapid stop by a brake (not shown).

The abovesaid operation and structure of the winder are already known, for example, by U.S. Pat. Nos. 3,913,852 granted to E. Lenk et al, October 21, 1975; and 4,216,920 granted to N. Tambara, August 12, 1980.

Since the general field balancing technique is disclosed, for example, in U.S. Pat. No. 4,098,127 granted to Fujisawa et al, July 4, 1978, details thereof are emitted in this specification, and only a part relating to the present invention will be described below.

In FIG. 1, sensors 25a and 25b for picking up the vibration are arranged at points X and Y on the revolving drum 9 in the vicinity of the bearings 10b and 10c, respectively, supporting the spindle shaft 4. A marker 26 is adhered to the plane C for determining a phase of the plane and a third sensor 27 is disposed in the vicinity thereof for detecting the marker.

When the spindle 1 is made to rotate, the signals derived from the vibration of the spindle due to unbalance are input to a field balancer 28 from the sensors 25a, 25b. At the same time, a signal derived from the rotation of the plane C is also input to the field balancer 28 from the sensor 27. In the field balancer 28, an amplitude and a phase of the vibration synchronized with the rotational speed of the spindle 1 are separated from a total vibration of the bearings 10b, 10c by passing the vibration signal and the rotational signal through a tracking filter built-in to the field balancer 28. Then, an amount and a phase of unbalance of the spindle 1 in the balance-correcting planes A, B, C, and D are determined by a computer calculation from the thus-obtained amplitude and phase data. The steps of the above measurement are described in more detail as follows:

(1) The spindle 1 in the assembled state is made to rotate without the addition of test weights in any of the planes A, B, C, D at a fixed rotational speed and the vibration is measured at points X and Y.

(2) The spindle 1 is made to rotate at the same speed as before while a known test weight is added to any one of the eight tapped holes 12a, and the vibration is measured at points X and Y.

(3) The same measurement is conducted after the test weight is removed from the plane A and, instead, another known test weight is added to the plane B.

(4) The measurements are continued while new test weights are sequentially added to the planes C and D, respectively.

According to this vibration data, a matrix of influence coefficient is calculated, which is a measure representing to what extent the test weight added to the respective balance correcting plane has an influence on the vibration of the spindle. Then, the optimum value and phase of a correction weight to be added to the respective balance-correcting plane A, B, C or D are calculated from the matrix by the computer so that the vibration is minimized at points X and Y. The thus-obtained correction value is distributed to the respective tapped holes of the respective balance-correcting plane by vector calculation.

The advantages of the present invention will be more apparent from the following description of an example of field balancing conducted on a revolving type yarn winder with automatic yarn transfer device shown in FIG. 2 provided with a spindle of the same structure as shown in FIG. 1. In this regard, a bobbin holding mechanism 3 was removed from the spindle to simplify the correcting operation for the plane B, because if the bobbin holding mechanism is mounted on the spindle, the plane B is always concealed, thereby making the correction operation difficult. However, if suitable apertures are preliminarily provided on the bobbin holding mechanism 3 and the bobbin 11b mounted thereon corresponding to the tapped holes 12b of the plane B, removal of the bobbin holding mechanism 3 may be unnecessary.

EXAMPLE 1

The spindle utilized for field balancing had a bobbin holding portion having a total length of 900 mm to carry four bobbins, each 225 mm in length, 94 mm in inner diameter, and 110 mm in outer diameter, and was made to rotate at a linear speed of from 5,000 m/min to 6,000 m/min, which corresponds to the maximum rotational speed of from 14,470 rpm to 17,360 rpm.

Regarding the critical speed, the first critical speed was 1,800 rpm, the second critical speed of the spindle which is one of the critical speeds of the spindle at each of which a violent lateral vibration of the spindle occurs, and which appears secondly during increasing of rotational speed of the spindle from zero, and which arises mainly from the vibration of the tubular supporting member, hereinafter referred to as the second critical speed, was 4,500 rpm, the third critical speed of the spindle at each of which a violent lateral vibration of the spindle occurs, and which appears thirdly during increasing of rotational speed of the spindle from zero, and which arises mainly from the vibration of the rearward cylindrical hollow body of the bobbin holding portion of the spindle, hereinafter referred to as the third critical speed, was 21,000 rpm. This spindle is designed to be utilized in the rotational range below the third critical speed.

Such a long spindle having a flexible structure exhibits different vibration modes when passing the first critical speed and during the working rotation. Particularly, the latter vibration is made more complicated by the influence of the vibration of the tubular supporting member 5, the vibration of which occurs during acceleration and is transmitted to the spindle 1 through the bearing 10a.

In the spindle of this example, since the bearing 10a was positioned in the middle region of the spindle by taking the working condition into account, the tubular supporting member 5 for holding the bearing 10a must be longer in size and, therefore, the second critical speed appeared at 4,500 rpm. The second critical speed can be changed according to machine design, if possible, such as by positioning the bearing 10a closer to the bearing 10b, by which the second critical speed becomes much higher relative to the former case. This means that the working range of the spindle rotation, is widened. In the extreme case, the tubular supporting member may be eliminated so that the spindle is held only by a pair of bearings 10*b* and 10*c*.

When the field balancing was applied to the spindle, three levels were selected in spindle rotation: first, 1,600 rpm in the vicinity of the first critical speed; second, 3,500 rpm in the vicinity of the second critical speed; and, third, 13,000 rpm in the high speed working range. The vibrations in the above levels were detected at points X and Y on the revolving drum, and the field balancing operation was carried out in the planes A, B, and C, respectively. The value of correction obtained from the influence coefficient matrix is listed in Table 1.

TABLE 1

| Balance Correction Plane | Correction Value | |
|---|---|---|
| | Weight (g) | Phase* (degree) |
| A | 3.2 | 320 |
| B | 6.8 | 163 |
| C | 2.3 | 217 |

In this regard, since the correction weights to be added to the plane A and B were too large, the addition of the correction weight was partly offset by boring the plane at a reverse phase position.

Figure 3:
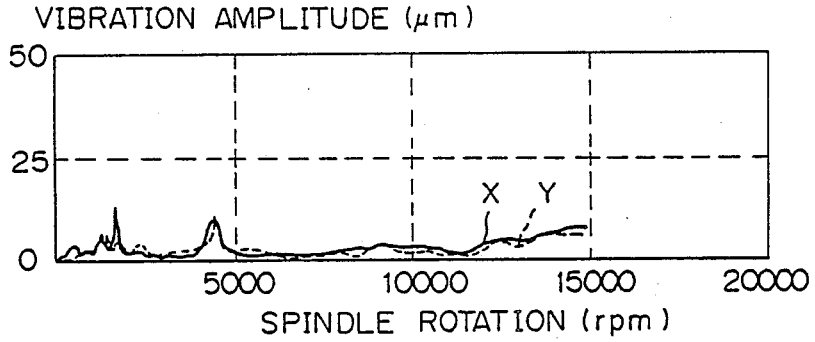
FIGS. 3, 4 and 5 are graphs showing, respectively, the results of vibration tests of the spindle according to the first aspect.

According to the addition of the correction weight to the respective balance correcting planes, vibration of the spindle at the points X and Y when passing the first critical speed and the second critical speed were suppressed below a lower level as shown in FIG. 3. This tendency also holds true for the working speed area amount to 5,000 m/min (corresponding to 14,470 rpm). On the contrary, if a correction weight was not applied, the amplitude of vibration of the spindle exceeded 100 μm when passing the first critical speed.

To further improve the field balancing, a fourth balance-correcting plane D was added to the former three planes, positioned at the rear end of the spindle. In this case, three rotation levels were selected, i.e., 1,600 rpm in the vicinity of the first critical speed of the spindle, 3,500 rpm in the vicinity of the second critical speed, and 16,000 rpm in the uppermost working rotation area. The field balancing was conducted in a manner similar to that described above, and the results thereof are listed in Table 2.

TABLE 2

| Balance Correction Plane | Correction Value | |
|---|---|---|
| | Weight (g) | Phase (degree) |
| A | 4.0 | 296 |
| B | 8.2 | 177 |
| C | 3.1 | 161 |
| D | 1.7 | 76 |

Figure 4:
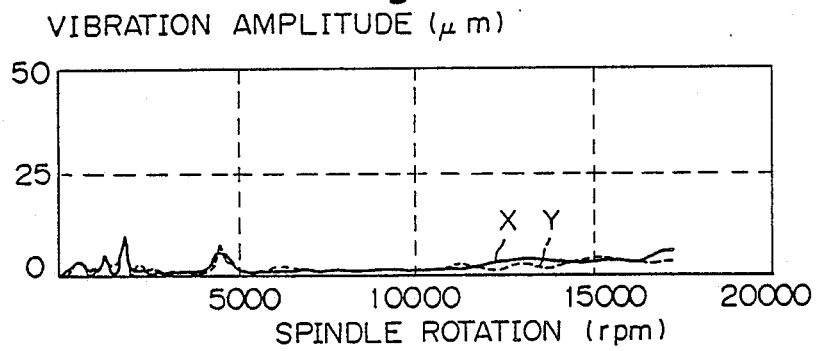

According to the field balancing method utilizing four planes, the vibration of the spindle was further suppressed even in the high speed area, as shown in FIG. 4.

Figure 5:
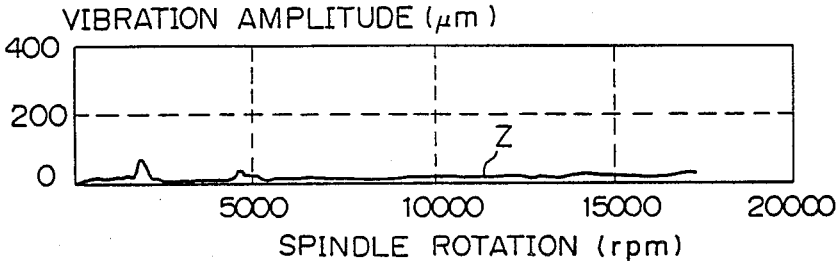

The up-down vibration at a tip end point Z of the lifting box is shown in FIG. 5, when the thus-balance corrected spindle was made to rotate and accelerate during a threading operation. As apparent from FIG. 5, there was little vibration at the lifting box, and the yarn take-up operation as well as the yarn transfer operation were smoothly continued. Even at the working speed of 6,000 m/min, either the vibration level or the noise level was very low.

In this regard, the distance between the respective balance-correcting planes were as follows:

A–B: 400 mm

A–C: 900 mm (corresponding to a length of the bobbin holding portion)

A–D: 1,500 mm

A comparative test was conducted by utilizing a spindle having the same structure as the Example under the same conditions as before, except for an omission of the plane B from the balance-correcting planes.

The correction value obtained thereby is listed in Table 3.

TABLE 3

| Balance Correction Plane | Correction Value | |
|---|---|---|
| | Weight (g) | Phase (degree) |
| A | 5.6 | 225 |
| B | | |
| C | 0.6 | 180 |
| D | 1.9 | 23 |

Figure 6:
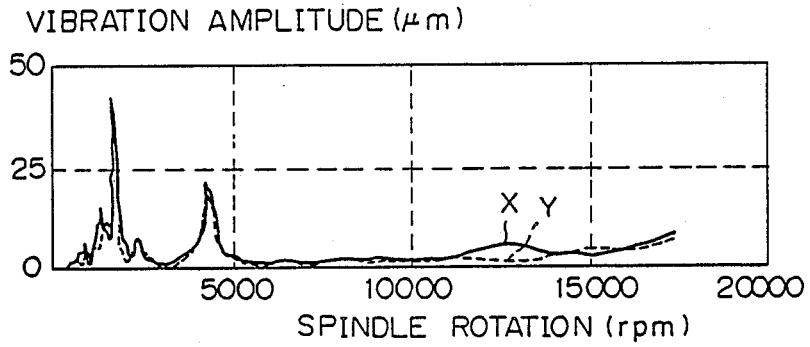
FIGS. 6 and 7 are graphs similar to FIGS. 4 and 5, respectively, showing the results of comparative tests.

The vibration of the spindle at the points X, Y is illustrated in a graph of FIG. 6, in which the vibration when passing the first critical speed and the second critical speed was larger than in the Example.

Figure 7:
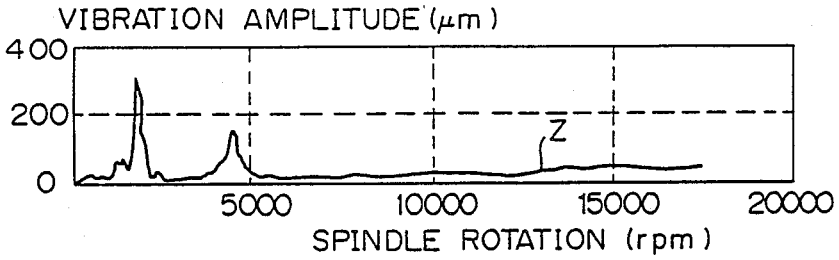

The up-down vibration at point Z of the lifting box is illustrated in a graph of FIG. 7 when the yarn transfer operation was carried out on a winder provided with the thus-balance corrected spindles. The accelerated spindle was largely vibrated when passing the first critical speed, which vibration was transmitted to the machine frame and to the lifting box, and finally, caused the yarn package formed on the spindle to jump from the touch roll. Moreover, the yarn winder provided with this spindle generated a louder noise, to deteriorate the working environment.

SECOND ASPECT

A second aspect of the present invention relates to the balance between spindles mounted on a revolving drum of a yarn winder having an automatic yarn transfer device.

In the above type yarn winder, one spindle mounting empty bobbins thereon must be accelerated during the threading operation in which a yarn is transferred from the yarn package to be doffed from the other spindle to the empty bobbins.

In the prior art, each spindle has the same structure and is secured on a common revolving drum under the same conditions. Therefore, the vibration factors of the respective spindle, such as the critical speed, become identical. When the yarn package to be doffed is small, as often seen in a small quantity production system, or when the threading operation is first carried out at a lower take-up speed on waste bobbins of one spindle before the yarn is actually taken up on empty bobbins of the other spindle rotating at a higher speed, the critical speed carrying the yarn packages or the waste bobbins is substantially identical to that of the other spindle carrying the empty bobbins. This means that two spindles having substantially the same vibration factors are rotating at the same high speed. Under these circumstances, the vibration of the respective spindle is liable to be amplified by resonance, making the yarn take-up operation unstable and the threading operation impossible. This amplification of the vibration is particularly significant in a tuning fork-like mounting of the spindles on the revolving drum.

The second aspect of the present invention aims to solve the above said problem caused by the consistency of the critical speed of the respective spindle.

Figure 8:
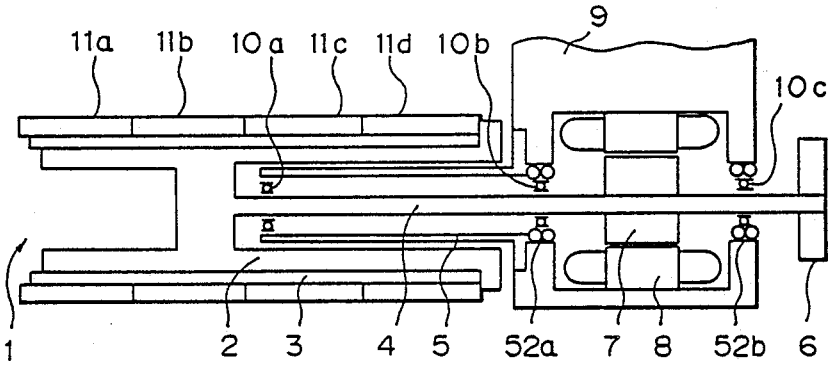
FIG. 8 is a diagrammatic sectional view of a spindle which may be balanced by a method according to a second aspect of the present invention.

FIG. 8 is a side sectional view of a spindle according to the second aspect. A spindle 1 supported horizontally in a cantilever manner has basically the same structure as the spindle shown in FIG. 1 of the first aspect, and the same reference numerals are used for designating similar parts.

A spindle shaft 4 is rotatably supported by a pair of bearings 10*b* and 10*c* arranged in a revolving drum 9 and another bearing 10*a* arranged at a tip end of a tubular supporting member 5 fixed to the revolving drum 9 in the same manner as shown in FIG. 1. The bearing 10*b* and 10*c* are held in a flexible manner in the revolving drum 9 through an intermediate resilient member such as O-rings 52*a* and 52*b*. According to this structure, the supporting conditions of the spindle shaft by the bearings are easily modified by changing the number of the O-rings, the hardness of the rubber forming the same, or the like.

Note the resilient member is not limited to an O-ring, although it is most preferably due to the availability and adjustability thereof, but may be another elastic means, provided it can support the bearing in a flexible manner.

Figure 9:
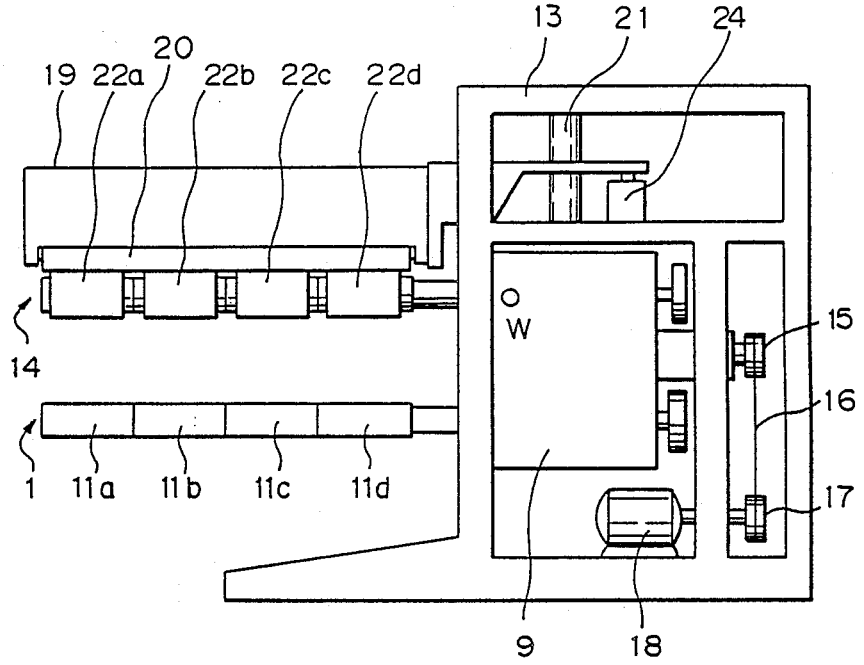
FIG. 9 is a diagrammatic sectional view of a yarn winder provided with the spindle shown in FIG. 8.

The spindle 1 is incorporated in a yarn winder together with another spindle 14 of the same structure as shown in FIG. 9, so that they constitute a parallel spindle pair. FIG. 9 is substantially identical to FIG. 2, except that the packages 22*a* through 22*d* are smaller than in the former case. It should be noted that the second spindle 14 is supported in the revolving drum 9 by bearings corresponding to the bearing 10*b* and 10*c* of the spindle 1, which, in turn, are held in a flexible manner different from that of the first spindle 1, by changing the number of O-rings.

When the yarn packages 22*a*, 22*b*, 22*c*, and 22*d* of the predetermined small amount are formed on the spindle 14, the automatic yarn transfer operation is carried out in the same manner as stated with reference to the first aspect. In this case, the rotation of the spindle 1 is substantially equal to that of the spindle 14 because the diameters of the package or the bobbin on the respective spindles are substantially identical. The critical speed of the respective spindles, however, is different because the supporting means of the shaft such as the O-ring is different. Thus, the spindles 1 and 14 can be rotated without interference with respect to the vibration.

To alter the critical speed of the spindles, in place of the above difference of the supporting conditions, it is also possible to use a lighter or heavier material to form parts of the bobbin holding mechanism in the respective spindles, to differentiate the total weight of the spindles. Further, the structure of the spindle itself may be differentiated by, for example, changing the shaft diameter or the distance between the bearings.

In this regard, difference between the critical speeds of the respective spindles is preferably in a range of from 1% to 30%, more preferably from 1% to 20% and further more preferably from 1% to 10%.

The effects of the second aspect will be more apparent from the following example:

EXAMPLE 2

In a revolving type yarn winder having a structure similar to that shown in FIG. 9, a pair of spindles having a structure similar to that shown in FIG. 8 were mounted on the revolving drum. The respective spindles had a bobbin holding portion having a total length of 900 mm, on which four bobbins, each 225 mm in length and 94 mm in inner and 110 mm in outer diameters, respectively, were mounted. The spindle was made to rotate at the maximum speed of 6,000 m/min (corresponding to the rotational speed of 17,360 rpm).

The first spindle was supported by O-rings having a hardness degree of 70 so that the first critical speed thereof was 1,800 rpm, and the second spindle was supported by other O-rings having a hardness degree of 50 so that the first critical speed thereof was 1,780 rpm.

When the first spindle 1 was stationary and only the second spindle 14 was rotating at 6,000 rpm, the amplitude of vibration of the revolving drum 9 at a point W (see FIG. 9) was 5 μm. Then, the first spindle was started and accelerated to 6,000 rpm. The amplitude of vibration at the point W increased to 7 μm, or substantially the same level as before. Accordingly, the automatic yarn transfer operation was smoothly carried out without disturbance.

COMPARATIVE TEST

Both the spindles 1, 14 were supported through O-rings having the same hardness degree of 70, respectively.

The vibration test was conducted in the same manner as before. When only the second spindle 14 was rotated at 6,000 rpm, the amplitude of vibration was 5 μm. This was increased to 15 μm through 20 m by acceleration of the first spindle 1.

THIRD ASPECT

A third aspect of the present invention relates to a method of balancing a spindle in which a bobbin holding portion has a combined two part structure.

Figure 10:
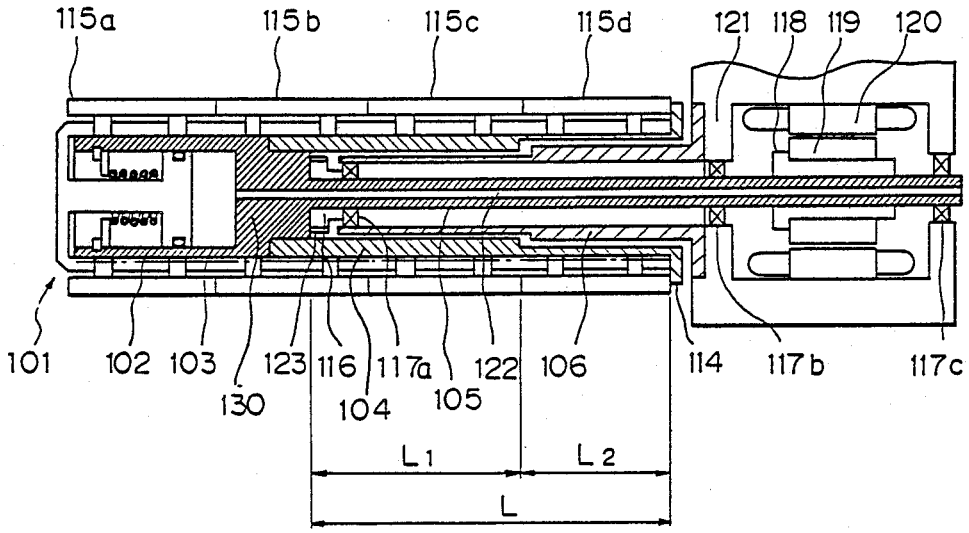
FIG. 10 is a diagrammatic sectional view of a spindle which may be balanced by a method according to a third aspect of the present invention.

With reference to FIG. 10, a spindle 101 is supported horizontally in a cantilever manner. The spindle 101 comprises a bobbin holding portion 102 on which a plurality of bobbins 115*a* through 115*d* are held by a known bobbin holding mechanism described later, and a spindle shaft 105 extending rearward coaxially with the bobbin holding portion 102 from one end thereof.

Figure 11:
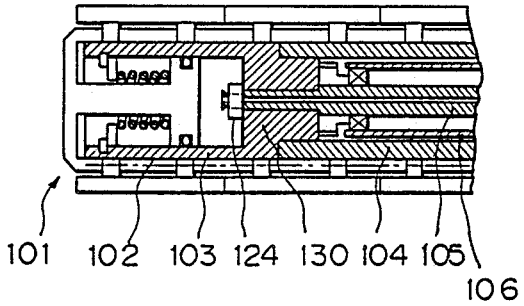
FIG. 11 is a partial view of a modification of the spindle shown in FIG. 10.

The bobbin holding portion 102 is divided into two parts; a forward cylindrical hollow body 103 and a rearward cylindrical hollow body 104 connected through a cylindrical and substantially solid body 130. The forward body 103 is integral with the shaft 105 in the embodiment shown in FIG. 10. However, the structure of the forward body 103 and the shaft 105 is not limited thereto but these parts may be separate and then fixed together by shrink-fitting or by using a set screw as shown in FIG. 11. According to the set screw connection, the two parts can easily be separated by unscrewing, if necessary. On the other hand, the forward and rearward bodies 103 and 104 are rigidly fastened to each other by shrink-fitting the inner end of the forward body 103 having a smaller diameter into an interior of the rearward body 104. Also in this case, welding or press-fit connection may be utilized instead of shrink-fit for fastening the two parts. In summary, any means may be adopted, provided the two separate bodies can be rigidly connected to form an integral longer bobbin holding portion 2.

The rearward cylindrical hollow body 104 preferably has a wall thickness thinner in the longitudinal inner region and thicker in the outer region. In the embodiment shown in FIG. 10, the wall thickness is once changed stepwisely in the midportion thereof. The thickness change, however, may be in two, three or more steps, or even in a tapering manner. According to this wall thickness, the second critical speed which arises mainly from the vibration of the rearward cylindrical hollow body 104 defined by the self-weight and stiffness becomes higher than that in the case when the wall thickness is uniform throughout the length thereof.

A tubular supporting member 106 is fixed at the end thereof to a base 121 by screws (not shown) and is projected into the interior of the rearward body 104. The base 121 is mounted on a machine frame (not shown). The shaft 105 is rotatably supported by a bearing 117*a* disposed at the innermost end and a pair of bearings 117*b* and 117*c* arranged in the base 121. A rotor 119 of a motor (not shown) is mounted on the shaft 105 between the bearing 117*b* and 117*c* through an intermediate member 118 in a tubular form shrunk-fit to the shaft 105. A stator 120 is fixed to the base 121 at a position corresponding to the rotor 119 so that the torque is transmitted to the shaft 105. A function of the intermediate member 118 is an improvement of stiffness of the shaft 105 having a small diameter necessary for being held in the narrow space. Accordingly, the intermediate member 118 may be shrunk-fit between the bearings 117*a* and 117*b* instead of, or in addition to, between the bearings 117*b* and 117*c*, if the working condition allows.

According to the above structure of the spindle, the bobbin holding portion is formed by two separately prepared cylindrical hollow bodies. Since the respective cylindrical body 104 or 103 has a shorter length, machining of the inner and outer surfaces of each the body can be accurately performed without axial eccentricity, whereby the spindle integrated therewith is also well-balanced and free from vibration at a high working speed.

In addition, the rearward cylindrical hollow body 104 has a thinner wall thickness in the rear half region so as to decrease the weight of the free end, and on the other hand, has a thicker wall thickness in the front half region so as to ensure the rigid connection with the forward cylindrical hollow body 103. According to this design, the critical speed which arises mainly from the vibration of the rearward cylindrical hollow body 104 can be far higher than the working rotational range.

The effect of the change in wall thickness will be more apparent from the following example:

EXAMPLE 3

A spindle having the same structure as in FIG. 10 was used for the vibration tests. The spindle had a total length of 1,200 mm and eight bobbins were mounted thereon, each having a length of 150 mm and inner and outer diameters of 110 mm and 135 mm, respectively, and was made to rotate at a linear speed of 6,000 m/min corresponding to a rotational speed of 14,150 rpm.

A rearward cylindrical hollow body had a total length L of 550 mm including a thicker wall part having a length L1 of 300 mm and a thickness of 8 mm and a thinner wall part having a length L2 of 250 mm and a thickness of 4 mm, as shown in FIG. 10. The critical speed thereof was 16,500 rpm, which is far higher than the maximum working rotation of 14,159 rpm corresponding to the linear speed of 6,000 m/min.

Figure 12:
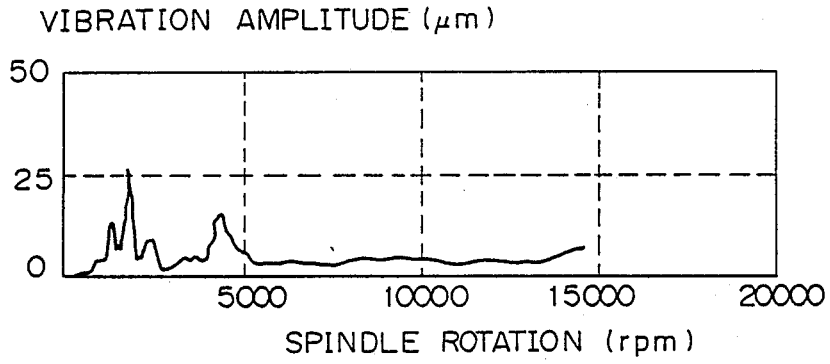
FIG. 12 is a graph showing the results of vibration test of the spindle according to the third aspect.

Vibration of the base 121 in the vicinity of the bearing 117*b* was measured at a point W in the same manner as described with reference to the first aspect, and the results thereof are illustrated in a graph of FIG. 12. According to the graph, the spindle has a stable working rotation in a range between the second critical speed of 4,200 rpm which arises mainly from the vibration of the tubular supporting member and the third critical speed of 16,500 rpm which arises mainly from the vibration of the rearward cylindrical hollow body of the bobbin holding portion of the spindle.

COMPARATIVE TEST

Figure 13:
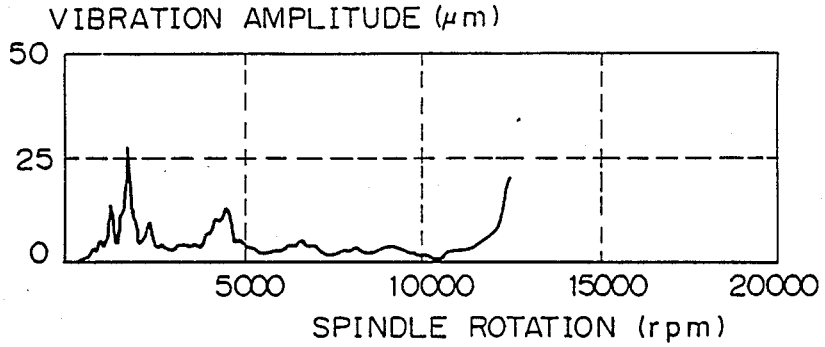
FIG. 13 is a graph similar to FIG. 12 showing the results of comparative tests.

Another spindle was used for comparative test, having the same structure and sizes as the above spindle, except that the rearward cylindrical hollow body had a uniform wall thickness of 8 mm throughout the length thereof. The third critical speed decreased to 14,000 rpm, and the vibration was greatly increased in the vicinity of 12,900 rpm, and thus the test had to be interrupted, as shown in a graph of FIG. 13.

Next, the effects of the intermediate member 118 shrunk-fit to the spindle shaft 105 will be described more specifically. In the case of the smaller diameter shaft, even a slight dynamic unbalance may cause a serious vibration in the spindle. Even if such an unbalance is corrected by field balancing or other means, so that the spindle rotation can easily pass the first critical speed and reach the normal working rotation range, the shaft 105 is still liable to locally bend between the bearings 117*b* and 117*c* due to a poor stiffness and a load from the heavy rotor 119. Provision of the intermediate member 118 shrunk-fit on the shaft restricts the bending tendency of the shaft and elevates the critical speed level of the shaft far above the working rotation range of the spindle. The intermediate member 118 must be mounted on the shaft 105 by a shrunk fit or press-fit so that no clearance exists between the engaging surfaces of both the parts. Therefore, a key and key-way fitting or welding, as conventionally used, cannot be adopted in the present invention.

The effects of the reinforcement of the shaft by the intermediate member shrunk-fit thereon will be more apparent from the following example:

EXAMPLE 4

A spindle having the same structure as in FIG. 10, in which the intermediate member made of steel S45C defined in the JIS (Japanese Industrial Standards) having a length of 230 mm, an outer diameter of 58 mm and an inner diameter of 35 mm and rigidly shrunk-fit on the spindle shaft, was used for the vibration test. The bobbin holding portion had a total length of 900 mm and four bobbins were mounted thereon; each having a length of 225 mm and inner and outer diameters of 94 mm and 110 mm, respectively, and was made to rotate at a linear speed of 6,000 m/min corresponding to a rotational speed of 17,360 rpm.

A diameter of the shaft was 35 mm, and a distance between the bearings 117*a* and 117*b* was 420 mm and that between the bearings 117*b* and 117*c* was 400 mm.

Figure 14:
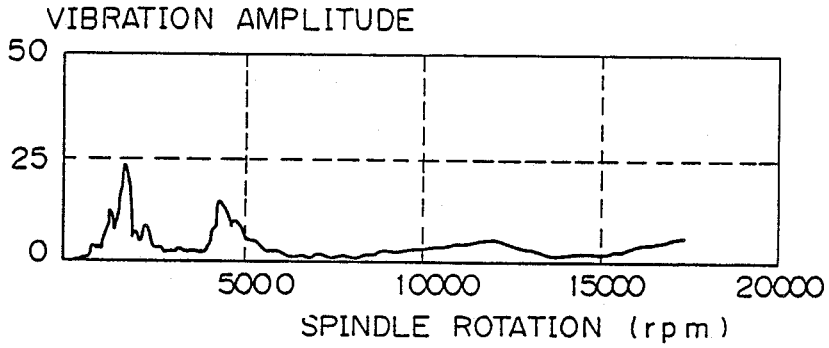
FIG. 14 is a graph showing further results of vibration tests according to the third aspect.

Vibration of the machine frame 121 in the vicinity of the bearing 117*b* was measured at X point in the same manner as described with reference to the first aspect, and the results thereof are illustrated in a graph of FIG. 14. According to the graph, the spindle had a stable working rotation in the area between the second critical speed of 4,500 rpm and the third critical speed of 21,000 rpm.

COMPARATIVE TEST

Figure 15:
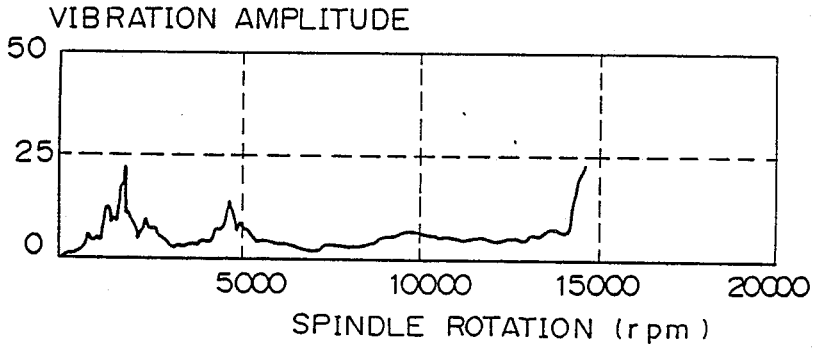
FIG. 15 is a graph similar to FIG. 14 showing the results of comparative tests.

Another spindle having the same structure and sizes as the above spindle, except that the intermediate member 118 was secured on the shaft by means of a conventional key and key-way system instead of a shrunk-fit, was used. The vibration and noise increased greatly in the vicinity of 14,500 rpm corresponding to a linear speed of 5,000 m/min and the test had to be interrupted, as shown in a graph of FIG. 15. This is because of the existence of a certain clearance necessary for securing the intermediate member on the shaft by the key and key-way system.

FOURTH ASPECT

A fourth aspect relates to a spindle structure enabling the easy removal of a bearing disposed in the innermost of the interior of a spindle according to the third aspect.

With reference to FIG. 10, a bearing 107*a* for supporting a spindle shaft 105 is secured at a free end of a tubular supporting member 106 inserted deep into the interior of a rearward cylindrical member 104. Since the bearing 107*a* is not exposed outside and is disposed in a narrow tubular space, exchange of the bearing is very difficult and the shaft is liable to be damaged during the removal operation.

To solve the above problem, according to this aspect, a special annular insert 116 is preliminarily incorporated in the structure. The insert 116 is slidingly mounted on the shaft 105 and positioned between the bearing 107*a* and the cylindrical solid body 130. The insert 116 is provided on the periphery thereof with a thread having a core diameter larger than an outer diameter of the bearing 107*a* and having an external diameter as small as possible.

A tool 150 (see FIG. 16) in a tubular shape is prepared for removal of the bearing, which tool has an inner diameter larger than an outer diameter of the bearing 117*a*, and an outer diameter smaller than an inner diameter of the rearward cylindrical hollow body 104. The tool 150 is provided in the inner wall of the tip end region with a thread engageable with the thread of the insert 116.

Figure 16:
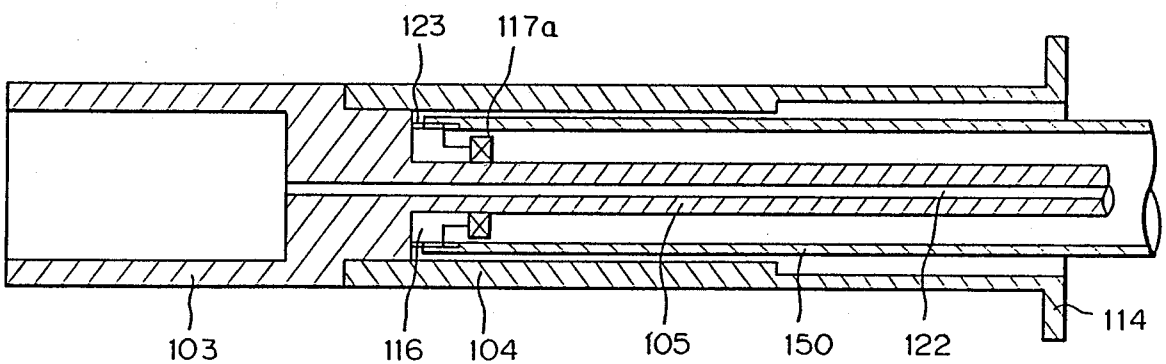
FIG. 16 is a diagrammatic sectional view of a spindle when a tool for removal of a bearing from the spindle according to a fourth aspect of the present invention is applied.

The removal operation will be described with reference to FIG. 16. To carry out the bearing removal operation, the tubular supporting member 106 must be first disassembled from the spindle. Then, the tool 150 is inserted into the interior of the rearward cylindrical hollow body 104 from the rear end thereof and rotated to threadedly engage with the insert 116. Thereafter, the tool 150 is pulled outward to move the insert 116 along the shaft 105. Since a sufficient dragging force is transmitted to the bearing 117*a* through the insert 116, the bearing 117*a* is also moved along the shaft 105, even if the bearing has rigidly bit to the shaft by, for example, heat generated during operation.

FIFTH ASPECT

A fifth aspect relates to an improved method for donning bobbins on a spindle according to the present invention without eccentricity between the bobbins and the spindle.

Even if the spindle is manufactured and corrected to be well-balanced as described in the preceding aspects, significant vibration may be generated in the yarn take-up operation due to bobbin mounting on the spindle. Accordingly, it is very important to don the bobbins on the spindle without unbalance, i.e., with as small an eccentricity as possible between the bobbins and the spindle.

Figure 17:
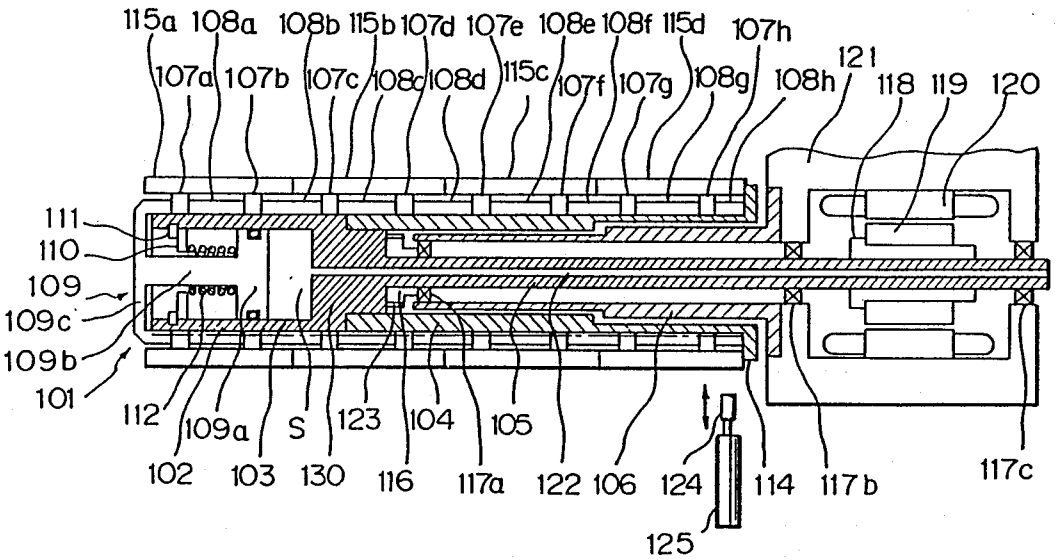
FIG. 17 is a diagrammatic sectional view of a spindle having a bobbin holding mechanism used for carrying out an improved method for donning bobbins according to a fifth aspect of the present invention.

A bobbin holding mechanism utilized in a spindle according to the present invention is illustrated, for example, in FIG. 17, which is substantially the same as FIG. 10 previously described, except that some parts are added for the explanation of the donning operation. Therefore, the same reference numerals are used to designate similar parts in the two drawings. As shown in FIG. 17, a bobbin holding mechanism comprises a pressing device 109, a group (eight in this case) of elastic rings 107*a* through 107*h*, and a group (eight in this case) of collars 108*a* through 108*h*. It should be noted that such a bobbin holding mechanism is already known in the art, for example, by U.S. Pat. Nos. 3,593,932 granted to M.V. Altice et al, July 20, 1969; 3,593,934 granted to P. Conrad et al, July 20, 1969; 3,813,051 granted to H. B. Miller, May 28, 1974; and Japanese Examined Patent Publication (Kokoku) No. 55-8424, Toray Industries, March 4, 1980.

The elastic rings 107*a* through 107*h* are slidably mounted on the bobbin holding portion 102 of the spindle 101 with a predetermined space therebetween so that they are uniformly distributed along the bobbin holding portion. The collars 108*a* through 108*h* are also slidably mounted on the bobbin holding portion 102 between the respective elastic rings 107*a* through 107*h* so that no gap exists therebetween. The pressing device 109 is disposed in the front area of the forward cylindrical hollow body 103 with a piston 109*a* slidably engaged with the inner wall of the forward cylindrical hollow body 103. A piston rod 109*b* extends outward from the piston 109*a*, and a presser 109*c* is integrally connected to the outer end of the piston rod 109*b*. The piston 109*a* is always biased inward by a compression spring 112 accommodated between the piston 109*a* and a retainer 110 held by a stop ring 111. A space S remains in the innermost area of the interior of the forward cylindrical hollow body 103 between the piston 109*a* and the cylindrical solid body 130. A longitudinal channel 122 is bored through the shaft 105 and the solid body 130 and reaches the space S. According to this structure, when the bobbin holding mechanism is out of operation, a pressurized fluid is supplied to the space S through the channel 122 so that the piston 109*a* is forwarded to release a compression on the elastic rings 107*a* through 107*h* imparted by the spring 112. Thereby, the respective elastic ring maintains a normal shape with a smaller diameter.

Figure 18:
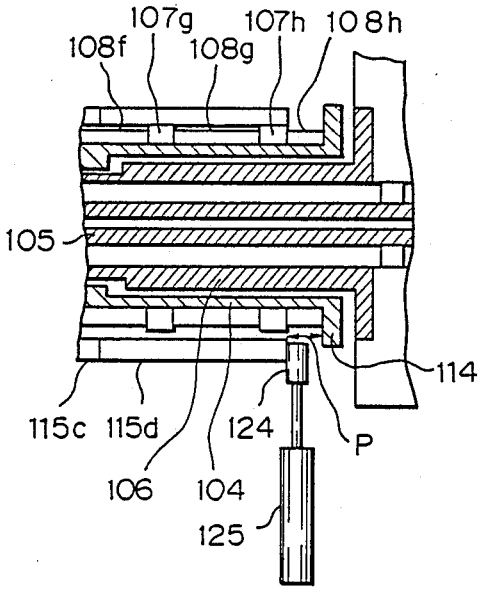
FIG. 18 is a partial view of FIG. 17.

Before bobbins are donned, as shown in FIG. 18, a power cylinder 125 disposed vertically to the spindle in the vicinity of the root of the bobbin holding portion 102 is operated to forward a stop 124 secured at a tip end of the power cylinder, until reaching a position close to the periphery of the bobbin holding portion 102. It should be noted that the stop 124 is positioned relative to the length of the spindle so that a predetermined distance P exists between an end flange 114 of the rearward cylindrical hollow body 104 and the stop 124. Then the bobbins 115*a* through 115*d* (four in this case) are sequentially mounted on the spindle so that no gap remains between any adjacent bobbins and the topmost bobbin 115*d* abuts against the stop 124. In this state, the bobbins 115*a* through 115*d* are held only by the upper surface of the elastic rings 107*a* through 107*h* and a gap appears at the opposite side thereof, because the bobbins are liable to hang down due to their own weight.

Then, the power cylinder 125 is operated in reverse to retract the stop 124 from the operable position. Thereafter, supply of the fluid to the space S is stopped so that the pressure originated from the spring 112 is applied on the elastic rings 107*a* through 107*h* through the presser 109*c* and the respective collars 108*a* through 108*h*. According to this pressure, the respective collars 108*a* through 108*h* are smoothly displaced in the lengthwise direction while the bobbins are moved through the distance P, during which process the elastic rings 107*a* through 107*h* are pressed between the collars and deformed so that a diameter of the respective ring is uniformly enlarged and is tightly engaged with the inner wall of the bobbins 115*a* through 115*h*.

If the vacant distance P is not preliminarily provided in a root portion of the bobbin holding portion, as in the prior art, the smooth displacement of the respective elastic ring and collar is not disturbed by the bobbin, which is immobilized by the flange 114. It is apparent that uniform deformation of the respective elastic rings and, therefore, favorable donning of the bobbins without eccentricity cannot be expected under such conditions.

The effects of this improved donning of bobbins will be more apparent from the following Example:

EXAMPLE 5

A spindle having the same structure as in FIG. 17 was used for the vibration test. The bobbin holding portion had a total length of 900 mm and four bobbins were mounted thereon, each having a length of 225 mm and inner and outer diameters of 94 mm and 110 mm, respectively, and was made to rotate at a linear speed of 6,000 m/min corresponding to a rotational speed of 17,360 rpm.

A diameter of the shaft was 35 mm, and a distance between the bearings 117*a* and 117*b* was 420 mm and that between the bearings 117*b* and 117*c* was 400 mm.

The bobbins were donned while initially keeping the distance P at 4 mm.

Figure 19:
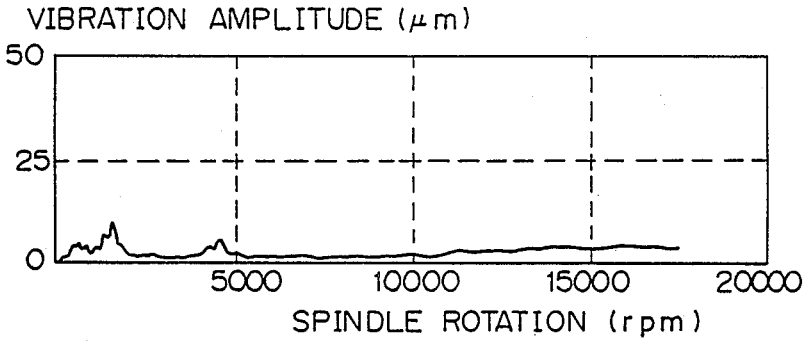
FIG. 19 is a graph showing the results of vibration tests according to the fifth aspect.

Vibration of the base 121 in the vicinity of the bearing 117*b* was measured at a point X in the same manner as described with reference to the first aspect, and the results thereof are illustrated in a graph of FIG. 19. According to the graph, it is apparent that the spindle had a stable working rotation in the wider range of from 5,000 rpm to 17,360 rpm. Particularly, the rotation corresponding to the first critical speed and the second critical speed could be passed without significant vibration.

COMPARATIVE TEST

Figure 20:
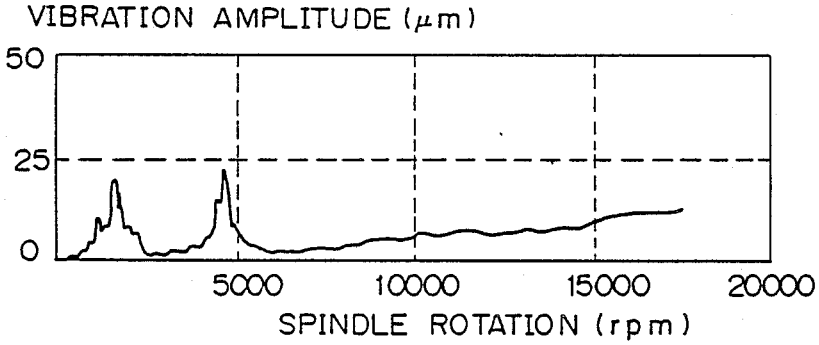
FIG. 20 is a graph similar to FIG. 19 showing the results of comparative tests.

The bobbins were donned on the same spindle as used in the Example without provision of the vacant distance P. The vibration test results are shown in a graph of FIG. 20, in which the vibration and noise of the spindle in the working range were significant, particularly in the high speed range. Further, the vibration level when passing the first critical speed and the second critical speed was also high, whereby the free end of the spindle was violently oscillated.

The following is claimed:

1. In a method of balancing a spindle in a yarn winder, wherein the yarn winder comprises:

(a) a base mounted on a machine frame for supporting a yarn take-up means, and (b) the yarn take-up means including, (b-1) a spindle driving mechanism mounted to the base, (b-2) a long spindle comprising, (b-2-1) a bobbin holding portion more than 800 mm in length including a first cylindrical hollow body, a cylindrical and substantially solid body connected to the first cylindrical hollow body and a second cylindrical hollow body connected to the cylindrical solid body, and (b-2-2) a shaft extending from a center of the inner end of the cylindrical solid body along the axis thereof through the interior of the second cylindrical hollow body and projecting therefrom, the shaft being connected to the spindle driving mechanism, (b-3) bearing means for rotatably supporting the spindle on the base, and (b-4) a bobbin holding mechanism secured around the periphery of the bobbin holding portion, for detachably mounting thereon at least a bobbin for taking up a yarn, the steps which comprise balancing the bobbin holding portion dynamically by field-balancing carried out by adjusting a test weight in each of at least three planes defined at opposition ends of the bobbin holding portion and an intermediate point therebetween, each of the weights being determined from sensing vibration data obtained by vibration testing carried out with and without an added test weight in each of said at least three planes extending at an angle to the axis of said spindle.

2. The method as defined in claim 1, including the step of mounting a plurality of the yarn take-up means on the base.

3. The method as defined in claim 1 or 2, wherein the shaft of the spindle extends outwardly through the base and a disc is secured on the outer end of the shaft, and wherein the balancing step is carried out on the disc.

4. The method defined in claim 1 or 2, wherein a tubular supporting member is stationarily mounted on the base in a cantilever manner for supporting the spindle, and wherein a free end of the tubular supporting member is projected into the interior of the second cylindrical hollow body, and further including the step of rotatably holding the spindle by the tubular supporting member through bearing means.

5. The method defined in claim 4, including the step of positioning the bearing means for rotatably holding the spindle relative to the tubular supporting member between the inner periphery of the tubular supporting member and the outer periphery of the shaft.

6. The method defined in claim 1 or 2, including the step of forming second cylindrical hollow body separately from the cylindrical solid body and integrating the former into the latter.

7. The method defined in claim 1 or 2, wherein the wall of the second cylindrical hollow body is thicker in the area closer to the cylindrical solid body and thinner in the area farther therefrom.

8. The method defined in claim 5, further comprising the step of providing an annular insert mounted on the shaft between the bearing means positioned between the inner periphery of the tubular supporting member and the outer periphery of the shaft and the cylindrical solid body, the annular insert having an outer diameter larger than that of the bearing means and being provided with a thread on the periphery thereof.

9. The method defined in claim 2, wherein the critical speeds of the respective spindles held on the base are positively differentiated by a difference between supporting conditions of the bearing means to the base.

10. The method defined in claim 9, wherein the difference between the critical speeds of the respective spindles is in a range of from 1% to 30%.

11. The method defined in claim 10, wherein the difference between the critical speeds of the respective spindles is in a range of from 1% to 20%.

12. The method defined in claim 11, wherein the difference between the critical speeds of the respective spindles is in a range of from 1% to 10%.

13. In a method of balancing a spindle which is carried by a tubular supporting member and is more than 800 mm in length, said spindle exhibiting at least three critical speeds of excessive vibration as the speed of its rotation is brought up to running speed, said critical speeds comprising (a) a speed which is the critical speed of the spindle, (b) a greater and different speed which is the critical speed of the tubular supporting member, and (c) a still greater speed which is the critical speed of the bobbin holding portion of the spindle, the steps which comprises:

(a) establishing at least three separate measurement planes extending at an angle to the spindle, the tubular supporting member and the bobbin holding portion of the spindle, (b) mounting test weights securely and detachably along said respective planes, (c) running up the rotation speed of the spindle and separately sensing the respective critical speeds, (d) in response to the sensing step determining the amounts and angles of rotation of compensating weights applicable in each of said three planes, and (e) affixing balancing weights in the determined amounts and at the determined rotational angles in each of said three planes.

14. The method defined in claim 13, wherein said spindle is supported for rotation by a plurality of bearings, wherein said sensing step is carried out in approximately the planes of the bearings, and wherein the three separate planes in which the test weights are added are different from the planes of the bearings.

15. The method defined in claim 13, including the preliminary steps of rotating the spindle without any test weights and determining the amount and phase of inbalance of the spindle in said at least three separate measurement planes.

16. The method defined in claim 13 wherein said separate measurement planes extend substantially at right angles to the axis of rotation of the spindle and interest it respectively at about the rear end of the spindle, an intermediate portion of the spindle and the tip end of the spindle.

17. The method defined in claim 13 wherein the test weights are added and the sensing steps are conducted one at a time in individual measurement planes.

18. The method defined in claim 13 wherein the spindle is provided with a brake, wherein a further measurement plane is established in the area of said brake, and wherein the sensing and field balancing steps and the correcting weight are applied in said plane.

19. The method defined in claim 13 wherein a plurality of such spindles are mounted in a common support, and wherein at least one such spindle is mounted on elastically supported bearings or otherwise differentiated from the other spindle as to its critical speeds.

20. The method defined in claim 13 wherein the spindle is composed of separate parts including a forward and a rearward portion attached to each other, and wherein the rearward portion has less wall thickness than the forward portion.

* * * * *